US005284071A

United States Patent [19]

Brettes et al.

[11] Patent Number: 5,284,071

[45] Date of Patent: Feb. 8, 1994

[54] UNFOLDING BOLT TIGHTENING SPANNER

[75] Inventors: Philippe Brettes, Saint Ouen; José C. Guillard, Souppes sur Loing, both of France

[73] Assignee: Societe Nationale d'Etude et de Construction de Moteurs d'Aviation "SNECMA", Paris, France

[21] Appl. No.: 982,941

[22] Filed: Nov. 30, 1992

[30] Foreign Application Priority Data

Jun. 18, 1992 [FR] France ..... 92 07399

[51] Int. Cl.[5] ..... B25B 21/00

[52] U.S. Cl. ..... 81/57.14; 81/57.31

[58] Field of Search ..... 81/57.14, 57.24, 57.3, 81/57.31

[56] References Cited

U.S. PATENT DOCUMENTS 2,830,479 4/1958 Finn .
3,477,318 11/1969 Butten .
3,987,691 10/1976 Savage .
4,287,795 9/1981 Curtiss .
4,926,699 5/1990 Salce, Sr. .

*Primary Examiner*—D. S. Meislin
*Attorney, Agent, or Firm*—Oblon, Spivak, McClelland, Maier & Neustadt

[57] ABSTRACT

A spanner for tightening or loosening bolts which includes a handle a fixed section and an articulated section which makes it possible to be opened out in inaccessible locations. Two shafts extend in the handle, one making it possible to open out the articulated section and the other to turn a collet or socket. A transmission mechanism is used which include two gear trains extending into the fixed and articulated sections. The spanner is applicable for tightening and loosening bolts located in normally inaccessible locations.

10 Claims, 4 Drawing Sheets

UNFOLDING BOLT TIGHTENING SPANNER

BACKGROUND OF THE INVENTION

1. Field of the Invention

The invention relates to an unfolding bolt tightening spanner or wrench.

2. Discussion of the Background:

Difficult access to bolts, for example, occurs when assembling or disassembling the superimposed rings of a compressor drum, which are assembled by flanges located on the side of the inner wall of the rings and between circular walls occupying most of the drum cross-section and which only leave room for the passage of a tool in a central well or shaft having a diameter smaller than the width of the drum rings between the well and the axis of the bolts. The problem then consists of lowering the tool in a retracted position along the axis of the drum to the desired height, then moving it in a direction perpendicular to the drum axis in the gap between two rings in order to reach the bolts of a flange, which is not possible with conventional tools.

The technical field has numerous more complex tools having transmission means and trains of various types between the portion from where the tool movement is controlled and the bolt tightening location. These tools are generally unsuitable either as a result of their lack of rigidity making it impossible to guide them with a sufficient accuracy in bent cavities (this being the case with spanners formed from sections joined by ball and socket joints), or due to their shape, which is only suitable for particular applications, or by their being not very practical use.

SUMMARY OF THE INVENTION

The tightening spanner or wrench according to the present invention is characterized by a tubular handle, a section fixed to one end of the handle, and another section articulated to one end of the fixed section remote from the handle. The sections are perpendicular to the handle, which contains two pivoting shafts and the fixed section contains a first transmission for turning the articulated section and moved by one of the shafts. The fixed and articulated sections also contain a second transmission terminated by a collet rotating on a portion of the articulated section remote from the fixed section, the second transmission being moved by the other of the two shafts.

Each of these transmissions can be constituted by gears forming a continuous train. In the case of the first transmission, it is terminated by a toothed ring located on the articulated section. In the case of the second transmission, the final wheel of the gear is integral with the locking part. The essential advantage of gear trains is their robustness.

If the two transmissions are constituted by gear trains, the overall dimensions can be reduced, provided that the two trains are formed in the fixed section by wheels in such a way that each wheel of one of the trains is coaxial to a wheel of the other train and stacked thereon, the coaxial wheels rotating independently. The overall dimensions of the handle can be reduced if the shafts are concentric.

When the tool is used for tightening several bolts distributed over a circular flange, it is advantageous for the spanner or wrench to be completed by a board or plate parallel to the section and arranged so as to support the handle by enabling it to pivot. This board can be provided with means for the reference marking of the angular position of the handle.

There is also a situation where the folding of the articulated section is impossible. The two sections will then be connected by a detachable articulation or joint.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
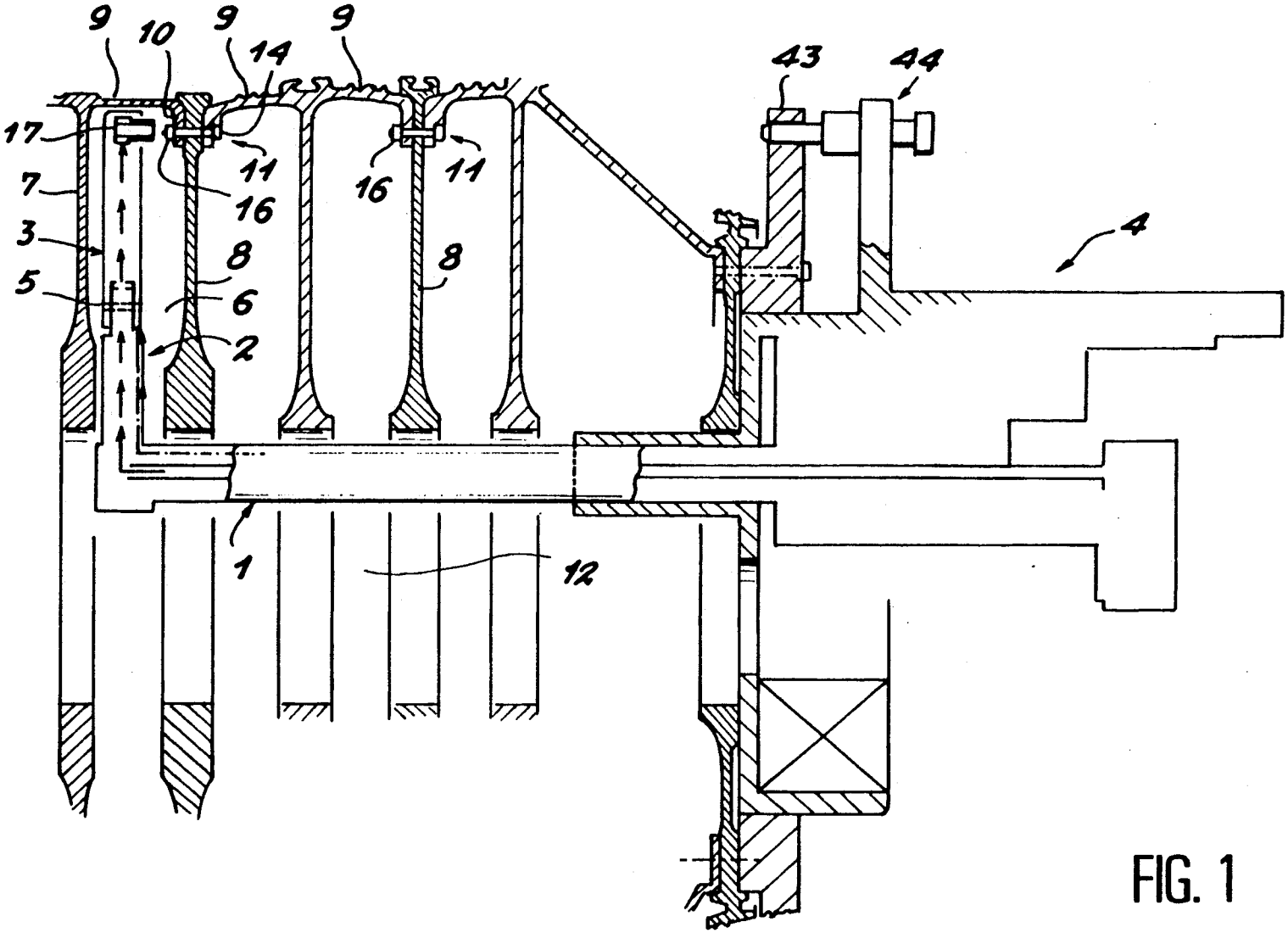
FIG. 1 is an overall view of the spanner engaged in a rotor drum and almost in the working position.

Reference should be made to FIG. 1, where the spanner is constituted by a tubular handle 1 and is provided at itw lower end with a fixed section 2 and an articulated section 3 and at its upper end with superstructures 4, which will be described hereinafter.

The two sections 2 and 3 extend in a horizontal plane and are interconnected by an articulation or joint 5. In the illustrated situation, sections 2 and 3 are an extension of one another and radially extend into an annular cavity 6, defined by two rings 7,8 of a compressor drum. One of the rings 7 carries a ferrule portion 9, which joins it to the other ring 8 and which is terminated by a ring-shaped, inner flange 10. Bolts 11 engaged in the inner flange 10 make it possible to assemble the rings 7 and 8. The rings 7 and 8, as well as the other, non-referenced rings, do not allow access to the bolts 11 except from a substantially cylindrical central well 12 of the diameter D, which is partly occupied by the significantly thinner handle 1 extending over a variable part of its height and as a function of the bolt 11 to be reached.

Figure 2:
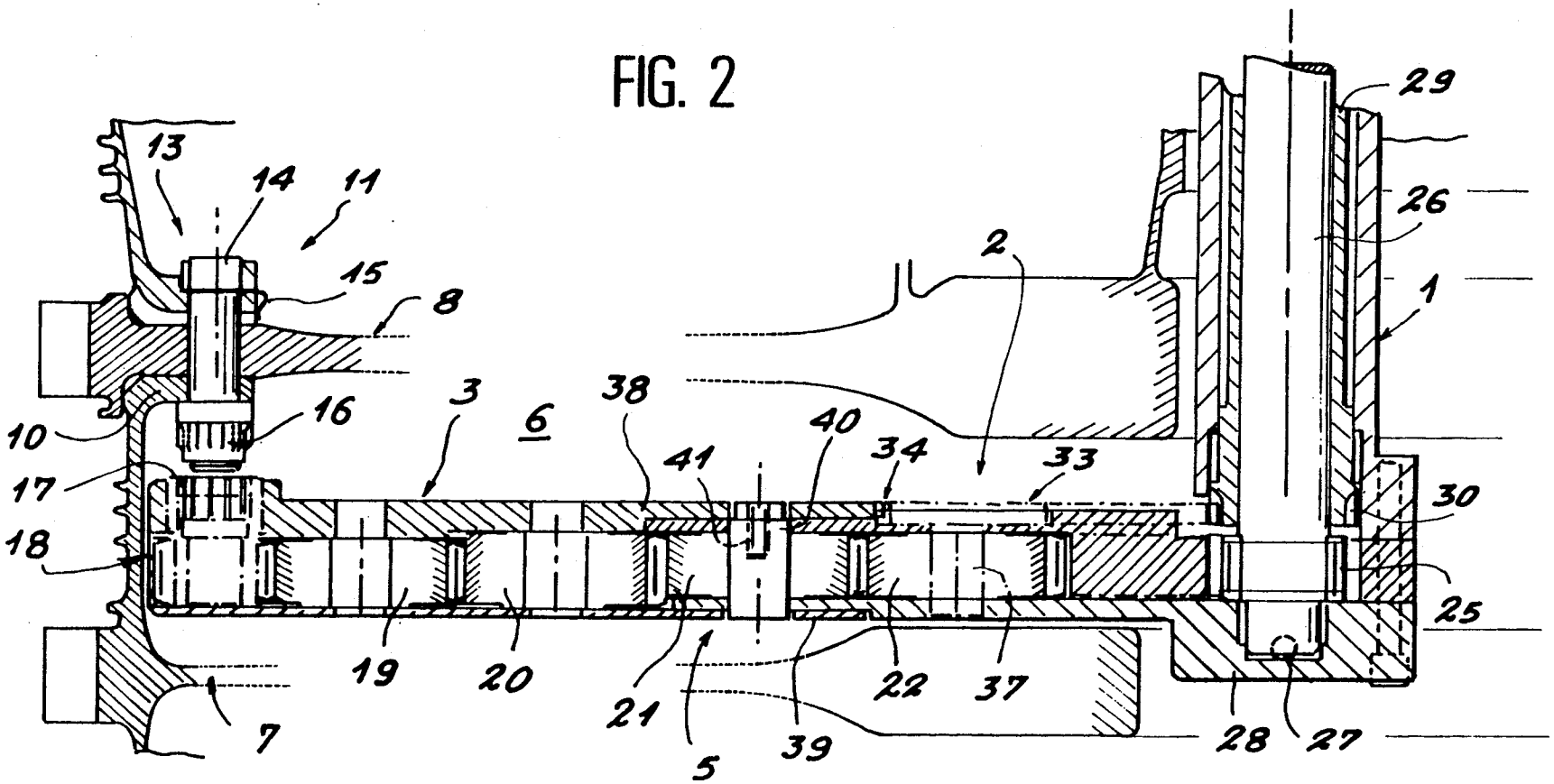
FIG. 2 is a larger scale representation of FIG. 1.

In connection with FIG. 2, the bolt 11 is constituted by a screw 13, installed at the stack of rings 7 and 8 and whose head 14 is provided with a brake 15 preventing it from turning, together with a nut 16, which is supplied by the spanner and held by a or socket collet 17 located at the end of the articulated section 3 opposite to the joint 5 before being screwed down.

The collet 17 is rotated by a series of toothed wheels 18 to 25 engaging with one another so as to form a continuous gear train. The first wheel 18 is integral with the collet 17, the wheels 18 to 21 extend into the articulated section 3, the wheels 22 to 24 (all shown in FIG. 3) extend into the fixed section 2 and the wheel 25, which extends into the handle 1, is located at the end of an inner shaft 26, which moves it on pivoting about its axis. The inner shaft 26 is axially held by a ball 27, which enables it to easily pivot above the bottom 28 of the handle 1 on which it bears.

The pairs of toothed wheels 21,22 and 24,25 permit the transmission of the movement of the handle 1 or articulated section 3 by the fixed section 2. These parts are consequently provided with openings in order to permit engagement.

An external shaft 29 concentric to the internal shaft 26 is positioned against the inner face of the handle 1 and also pivots or rotates therein independently of the internal shaft 26. It is terminated by a toothed wheel 30, which is the first of a gear train also constituted by three other wheels 31,32,33 (FIG. 3), which extend into the fixed section 2 and whereof the last meshes with a circular arc-shaped toothed surface 34 located externally of the articulated section 3 about the joint 5. The assembly forms another continuous gear train, which makes it possible to open out the spanner on rotating the articulated section 3 about the joint 5 as a result of pivoting of the external shaft 29. It should be noted that the toothed wheels 31 to 33 are placed on the wheels 24 to 22 respectively of the preceding train, so as to form three pairs of wheels rotating about a common respective spindle 35, 36 or 37. The three spindles are fixed to the structure of the fixed section 2 and enable the wheels of each pair to rotate independently.

Figure 3:
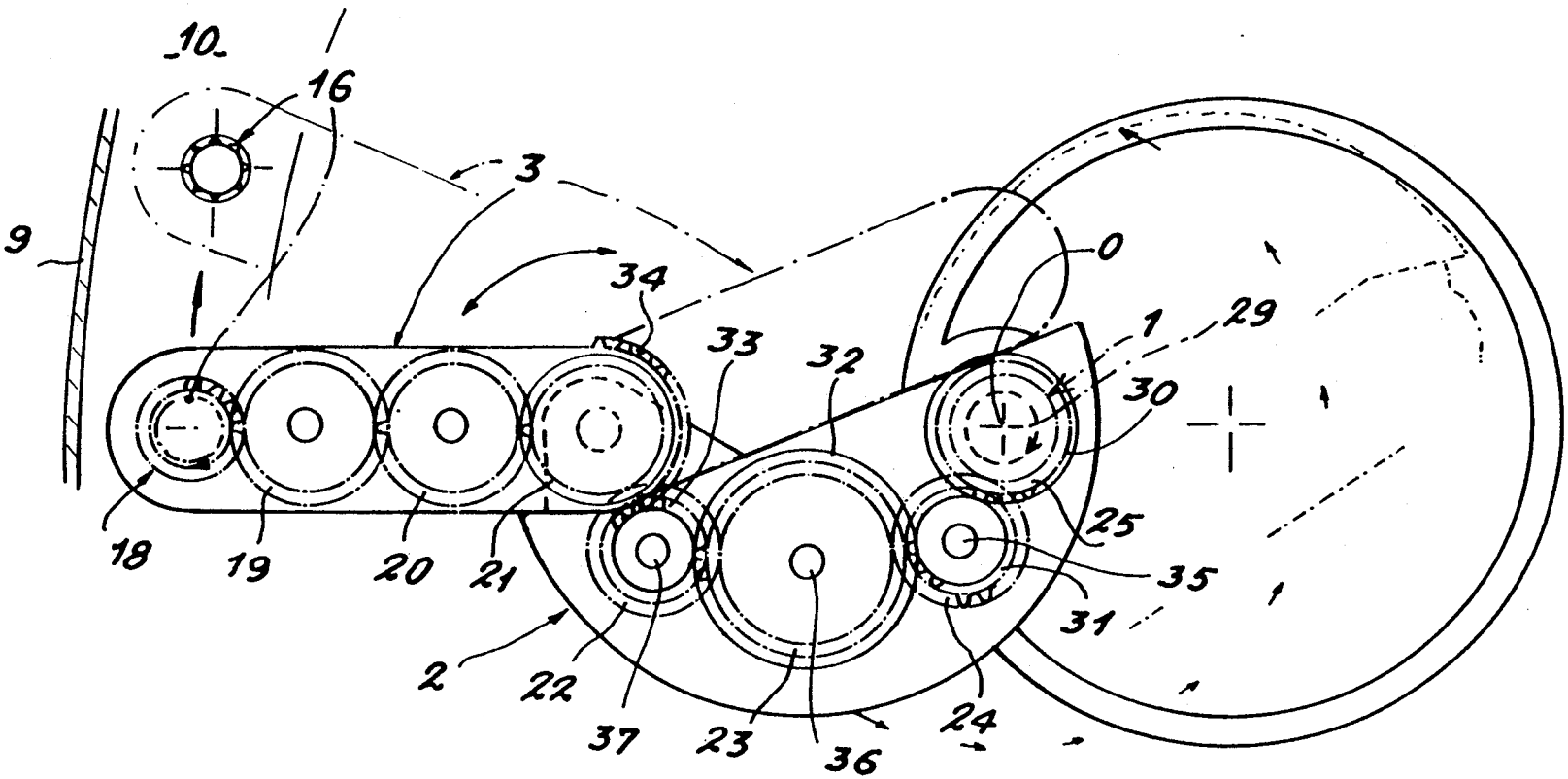
FIG. 3 is a plan view of the spanner before opening out.

FIG. 3 shows that when the spanner or wrench is folded, the articulated section 3 is joined to the fixed section 2 (dotted line position) and that the assembly is included in a circle of diameter D, which makes it possible to lower it into the well 12. In order to arrive at the position of FIG. 1, the handle 1 is displaced in order to bring it to the edge of the well 12 and then the external shaft 29 is moved in order to move the articulated section 3 so as to be substantially an extension of the fixed section 2 until they abut against one another. It is then possible to rotate the internal shaft 26 in order to screw down the nut 16 after placing the collet 17 beneath the screw 13. Unscrewing takes place by a reverse operation.

FIG. 2 shows that the articulated section 3 comprises an upper tongue 38 and a lower tongue 39, which surround the end of the fixed section 2. The upper tongue 38 is fixed to the articulated section 3, while the lower tongue 39 can be detached therefrom. It is in one piece with a spindle 40 (about which rotates the toothed wheel 21), whose apex is provided with a thread 41.

The spindle 40 passes through a hole in the upper tongue 38 and is flush with its surface. The spindle 40 and the holes of the tongues 38 and 39 are adjusted in rotary form. If it is impossible for any reason to fold the articulated section 3, it is then merely necessary to move the spanner in such a way that the spindle 40 is located in the well 12. It can then be easily dismantled with the aid of an extractor, whereof a screw end penetrates the thread 41. The handle 1 and the fixed section 2 are firstly removed, followed by the other parts. The spindle 40 is sintered in the holes of the fixed section 2 to maintain it in place.

Figure 4:
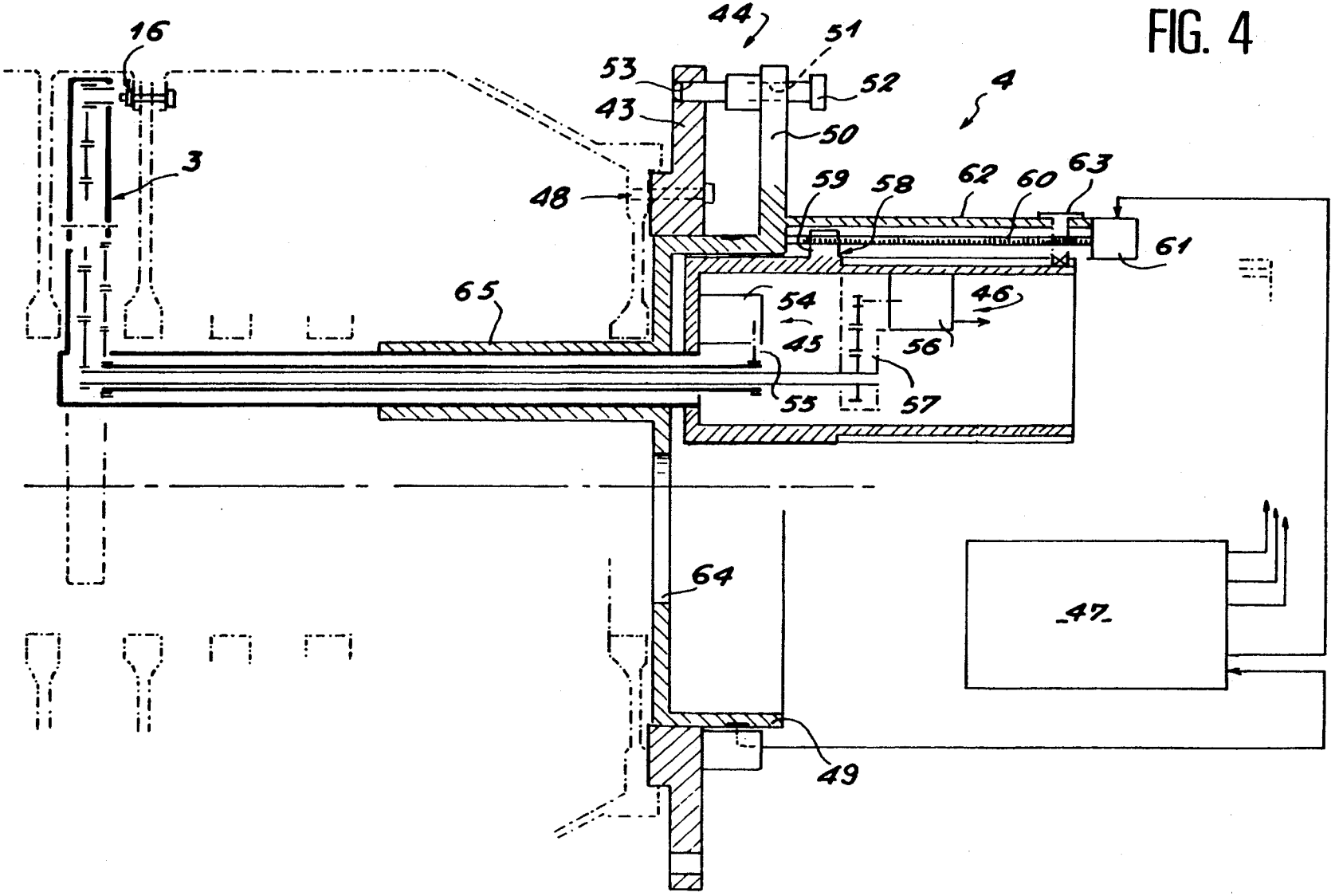
FIG. 4 is a longitudinal sectional view of the board.

Reference should be made now to FIG. 4. The superstructures 4 consist of a board or plate 43 placed on the drum, which can be fixed thereto and which carries a device 44 for indexing the angular position of the fixed section 2, an opening out device 45, a tightening device 46 and which are connected to a control and checking means 47 by electric wires and they can be completed by an optoelectronic case fixed to the end of the articulated section 3 in order to reference mark the displacements of the spanner, the rotation of the nut 5 and in general the satisfactory performance of the operations. This case can essentially contain a minicamera oriented towards the collet 17 or an endoscopic viewing means.

The board 43, like sections 2 and 3, is horizontal. It is provided with oblong holes 48 having a similar arrangement to those of the face of the drum on which the board 43 is located, so that the board 43 can be screwed to the drum in a position where the handle 1 is offset in the well 12 and where the collet 17 passes beneath the screws 13, when the articulated section 3 is opened out to the maximum.

The indexing device 44 consists of a lever 50, which extends over the board 43. Its outer end carries a vertical hole 51 in which is introduced a detent 52. When the detent 52 reaches the marking holes 53 made on the periphery of the board 43, it can be introduced into the same and lock the lever 50. The marking holes 53 are in angular correspondence with the screws 13. The opening out of the articulated section 3 is then commenced and the collet 17 is placed under a screw 13 as a result of the means contained in the optoelectronic case. The board 43 is then fixed to the drum. The oblong holes 48 make it possible to freely rotate the board 43 in order to correctly position the collet 17.

When tightening is ended, it is merely necessary to remove the detent 52 and to rotate the rotary plate 49, which is integral with the lever 50 and carries the handle 1, into the board 43 until the detent 52 can be introduced into another marking hole 53 for placing the collet 17 under another screw 13. The handle 1 has the same offcentering for all the angular positions, because the rotary plate 49 is coaxial to the well 12.

The board 43 can be replaced by another board with differently positioned reference marking holes 53, in order to make the tool comply with different distributions of the screws 16, or alternatively the holes 53 can be located on a detachable, replaceable part fixed to the remainder of the board 43 by a random means, which gives the same result.

The opening out device 45 consists of a motor 54, which drives the external shaft 29 by a not shown transmission 55 and which can comprise gears or a belt. The tightening or locking device 46 also consists of a motor 56 and a transmission 57 of the same type as hereinbefore and which drives the internal shaft 26. The checking and control device 47 can consist of a microcomputer, to which is added a torque transducer for stopping the motors 54 and 56 when they transmit an excessive force once the abutment state is reached. The transmissions 55 and 57 can be provided with torque limiters similar to those of dynamometer wrenches for the same purpose. It would obviously be possible for the tool to be operated entirely manually.

The raising of the handle 1 to place the collect 17 against the screw 13 or for changing the tightening stage is carried out if the handle 1 is equipped with a boss 58 provided with rack teeth or threads 59 on an outer surface. This mechanism cooperates with a vertical worm 60 and is moved by a motor 61 fixed to a rib 62 rising from the rotary plate 49. The handle 1, which is significantly widened above the rotary plate 49 so that it can carry the opening out 45 and tightening 46 devices, comes against the ribs 62, to which it is connected by a detachable key 63 located in grooves of the handle 1 and the rib 62. The threads or teeth 59 are maintained in the threads of the worm 60 in the keying position. The rotation of the motor 61 consequently raises or lowers the handle 1.

The detachable key 63 is removed to rotate the handle 1 on the rotary plate 49 and place the sections 2 and 3 in the well 12. The rotary plate 49 has a central bore 64 giving access to the joint between the sections 2 and 3 in order to dismantle them if necessary, as well as a tube 65 occupied by a median portion of the handle 1 and which serves as bearing to enable it to rotate without any obstacle.

We claim:

1. A spanner for tightening bolts, which comprises:

a tubular handle, a first section fixed to one end of the handle, a second section articulated to one end of the first section remote from the handle, the first and second sections being substantially perpendicular to the handle, the handle containing a first and second rotating shaft, the first section including a first transmission arranged so as to driven by the first shaft for rotating the second section with respect to said first section, wherein the first section and the second section contain a second transmission having a socket for rotating on a portion of the second section remote from the first section, and wherein the second transmission is driven by the second shaft.

2. A spanner according to claim 1, wherein the second transmission comprises a first plurality of gears forming a first continuous gear train.

3. A spanner according to claim 2, wherein the first transmission comprises a second plurality of gears forming a second continuous gear train in the first section and the second section has a toothed ring with meshes with said continuous train in the first section.

4. A spanner according to claim 3, wherein the first and second gear trains comprise, in the first section, a plurality of toothed wheels such that each wheel of one of the first and second gear trains is coaxial to a wheel of a remaining train of the first and second gear train, and is stacked thereon, and wherein the coaxial wheels rotate independently.

5. A spanner according to claim 1, wherein the first and second shafts are concentric.

6. A spanner according to claim 1, which comprises a fixed board parallel to the first and second sections for supporting the handle so as to permit pivoting of the second section.

7. A spanner according to claim 6, which comprises a device connected to said handle for rotating the handle and the first and second sections on the board.

8. A spanner according to claim 7, wherein the board includes a device for indicating the angular position of the handle.

9. A spanner according to claim 6, which comprises a device connected to said handle for axially displacing the handle relative to the board.

10. A spanner according to claim 1, which comprises a detachable joint for interconnecting the first and second sections.

* * * * *